United States Patent [19]

McConaughy

[11] 4,230,419

[45] Oct. 28, 1980

[54] HINGED FLOAT ATTACHMENT SYSTEM

[75] Inventor: David F. McConaughy, East Aurora, N.Y.

[73] Assignee: Albany International Corp., Menands, N.Y.

[21] Appl. No.: 973,091

[22] Filed: Dec. 26, 1978

[51] Int. Cl.[2] ..... E02B 15/04

[52] U.S. Cl. ..... 405/66

[58] Field of Search ..... 405/63, 64, 65, 66, 405/67, 68, 69, 70, 71, 72; 210/242 R

[56] References Cited

U.S. PATENT DOCUMENTS

| | | | |
|---|---|---|---|
| 3,798,913 | 3/1974 | Dubois | 405/66 |
| 3,922,860 | 12/1975 | Tanksley | 405/66 |
| 3,973,406 | 8/1976 | Casey | 405/70 |

FOREIGN PATENT DOCUMENTS

| | | | |
|---|---|---|---|
| 2009655 | 2/1970 | France | 405/66 |

*Primary Examiner*—Roy D. Frazier
*Assistant Examiner*—Alexander Grosz
*Attorney, Agent, or Firm*—Kane, Dalsimer, Kane, Sullivan and Kurucz

[57] ABSTRACT

A float assembly adapted to be mounted on an elongated collapsible belt to form a floatable boom. The assembly includes a support with attachment structure for mounting the float assembly on the belt. A float member is hinged to the support to be rotatable between a first position adjacent to the belt for storage and a second position laterally extended from the belt for facilitating floatation of the boom. The float member is also mounted for limited angular displacement with respect to the longitudinal axis of the belt when in the second position.

11 Claims, 4 Drawing Figures

HINGED FLOAT ATTACHMENT SYSTEM

BACKGROUND OF THE INVENTION

Since the major oil spill from the tanker Torrey Canyon approximately 10 years ago, there has been a concentrated effort toward development of systems for confining and cleaning up oil spills. The nature of an oil spill is such that the forces tend to spread the oil over the top surface of the water at a rapid and undesirable rate. Accordingly, it is of great value to be able to contain the oil until it can be removed from the surface of the water in any of a number of different manners.

Naturally the location of the spill, and particularly, the nature of the body of water enters into oil containment apparatus design. The problems encountered in the open sea differ from those encountered in harbor or river locations.

Since an oil spill can occur anywhere where there is a body of water, confinement apparatus should preferably be portable and easily handled, towed and assembled to surround and contain the spill in a quick and efficient manner. Thus, many designs of containment booms are directed to an easy to handle compact structure which can be easily stored when not in use and which can be quickly and efficiently arranged in operable position for use.

It has also been found to be effective to employ protective containment booms as preventive devices in harbor areas. In this environment, the object is to surround the ship containing pollutants with a portable boom while it is in the harbor so that any pollutant spill is contained within the boom and can be cleaned at the desired time without the fear of it spreading and extensively polluting waterfront areas. The boom designed for this purpose can be easily withdrawn and stored when a ship is to leave the harbor and when reused when another ship enters port.

Throughout the last 10 years it has been fairly well determined that an effective type of boom for accomplishing the above features is one which is light weight, flexible, easily towable and is stable in the form of a floating boom when in use. Accordingly, various types of floating flexible booms have been developed with detachable and permanently mounted floats thereon. The detachable floats naturally facilitate folding of the boom when it is stored. However, of course, this also requires an additional step in setting up and storing of the booms since each float has to be attached and detached individually. Other types of floating booms which have been developed include rigid buoyant floats rigidly attached to the flexible boom structure. Alternatively, sealed inflatable portions of the flexible boom can be formed so that the boom can be inflated for obtaining a buoyant condition. The variety of floating boom containment structures are numerous as stated above, and as evidenced by the comprehensive compilation of structures in the publication of the Edison Water Quality Research Laboratory of the U.S. Environmental Protection Agency dated January 1973 and entitled "Oil Containment Systems". For purposes of the present improved floating boom, it is believed that the most significant background patent is U.S. Pat. No. 3,922,860. It will be noted that this reference shows a lightweight inexpensive towable floating boom with floats that facilitate the towing action, floating action and folding of the boom for storage purposes.

SUMMARY OF THE INVENTION

With the above background in mind, it is among the primary objectives of the present invention to provide a unique float attachment for use with a flexible containment boom for pollutants such as oil wherein the boom containing the float attachments can be easily and quickly stored when not in use and can be effectively deployed and towed into the desired configuration and location in a quick and efficient manner. The system is lightweight and inexpensive construction. The float attachments are designed so that they are easily shiftable between a first position where folding of the boom structure is facilitated for storage and a second position where the floating of the boom in a vertical position is facilitated. The float attachments are designed so that they enable the float to tilt a predetermined angle either clockwise or counter clockwise to facilitate floating of the boom in deployed position as well as facilitating the towing of the boom to the desired location. A boom constructed with the float attachments of the present invention is usable in locations where major oil spills have occured and also in harbor situations as a protective device for quickly surrounding a ship or barge in port to prevent spreading of pollution that might occur.

It is an objective to provide float attachments which can be arranged in pairs on opposing sides of a vertical boom in the form of a flexible belt and spaced at predetermined intervals along the belt or belt sections to achieve the desired floating action. As stated above, the floats can be shifted to a position which facilitates folding and storage of the booms when not in use and then repositioning in the deployed position for retaining the boom in the upright vertical position when in use.

It is an objective to provide a float attachment with float members of conventional type of closed cell foam with each float being mounted to a cast float support. A float latch arm is provided to facilitate retention of the float in the deployed position.

The float is hinged to the support to permit its rotation into a position in close adjacent aligned relationship with the side of the belt for storage and permits rotation to the lateral horizontal position for floating. To facilitate retaining the float in the deployed lateral position, the latch arm engages with an appropriate recess in the float and the configuration and nature of the latch arm by cast in attitude of the latch arm with respect to the float or by natural resilience of the latch arm tends to retain the float in the horizontal or 90 degree position with respect to the barrier or belt by engagement with an appropriate recess on the float. When released the float will fall by gravity into closed parallel relationship to the side of the belt.

The present invention is designed with an axle for rotation of the float whereby the axle is journaled or mounted in a hub having a diverging inner diameter from the center to the outward ends thereof to permit tilting of the float either counter clockwise or clockwise a predetermined angular distance to facilitate towing and floating action of the floats and boom while confining the float to a latched position at approximately 90 degrees with respect to the belt or barrier and parallel to the water line. The amount of tilting action is a matter of choice and it has been found to be effective to provide approximately a 15 degree tilt with respect to the horizontal for the float.

It is also an objective to provide one or more rollers between the inner surface of the float and the support to alleviate and eliminate wearing action of sliding friction between the float and the fixed support structure as the float tilts or rotates to 15 degrees more or less and its inner or top edge engages with the float support during this tilting action. An appropriate float bearing surface is on the support to take the force of the rollers and eliminate unwanted friction of the float against the float support.

It is also an objective to provide axle lock bearing rings on the axle between the hub in which the axle is mounted and the ends of the axle which are mounted at appropriate recesses in the float to thereby lock the float in place and provide a bearing between the float and the hub ends. This prevents the axle from sliding one way or the other into the receiving recesses for the axle in the float. An appropriate cut-out is in the float for positioning the hub and axle and mounting of the float on the hub and axle and accordingly to the float support of the attachment system.

The attachment system is mounted to the belt or barrier by means of a flat plate support which substantially conforms to the configuration of one side of the belt and has the float rotatably mounted to the hub extending from one side of the support plate. The other side of the support plate is mounted directly to the belt and there is no axle extending through the belt thus alleviating the danger of possible pollution leaks through an axle hole or other aperture from one side of the system to the other.

The plate is bolted to the belt and to a mating plate on the opposite side of the barrier or belt. In this manner, a pair of opposing floats attachment assemblies are used to retain the belt in the vertical, buoyant and floating condition. The opposing plates are designed so that the bolts pass through apertures in the plate on one side and screw into lock nut threaded holes in the plate in the other side thereby eliminating the need of nuts and lock washers. This mating arrangement also allows for easier cleaning by providing smoother surfaces and the lack of holes. If desired, additional depth of material for the locking thread is obtained by providing a cast in raised nipple on the receiving support plate to receive the entire length of the threaded bolt extending from aligned apertures in the support plate on the other side of the belt.

The latch arm is designed with a lift ring to facilitate its removal and positioning in the appropriate latch well in the top of the float member. The float has a desired configuration for facilitating its towing and movement through the water as well as for obtaining maximum buoyancy. Thus, the float is a relatively large flat member with appropriate arcuate surfaces extending outwardly and downwardly to provide the desired planing surfaces for the float. To facilitate the latching action of the latch arm, it has been found effective to cast the float latch arm at 5 degrees down angle to provide spring tension for holding the arm locked down into the latch well in the top of the float. Naturally other angles or other resilient means can be employed for the same purpose as long as the desired effect is achieved that of retaining the float in the lateral deployed position for use while providing for ease of release of the latch arm to permit the float to rotate to the down position for storage and folding of the belt.

In summary, a float assembly is provided which is adapted to be mounted on an elongated collapsible belt to form a floatable boom. The float assembly includes a support with attachment means for mounting the float assembly on the belt. A float member is hinged to the support to be rotatable between a first position adjacent to the belt for storage and a second position laterally extended from the belt for facilitating floatation of the boom. The float member is mounted for limited angular displacement with respect to the longitudinal axis of the belt when in the second position.

With the above objectives among others in mind, reference is made to the attached drawings.

DETAILED DESCRIPTION

Figure 1:
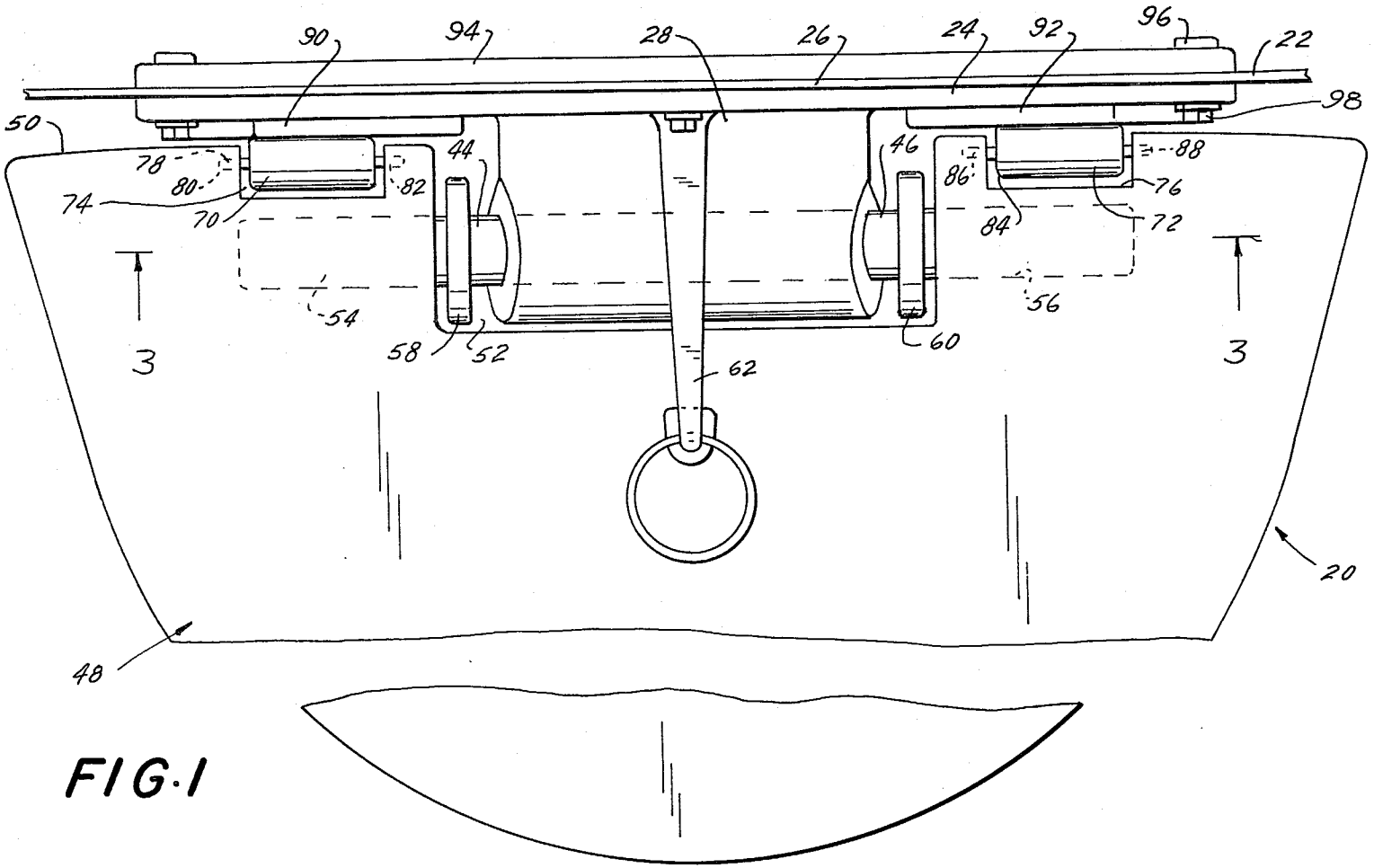
FIG. 1 is a fragmentary top plan view of the float assembly of the invention mounted on a belt of a floatable boom with the float in the deployed position.
Figure 2:
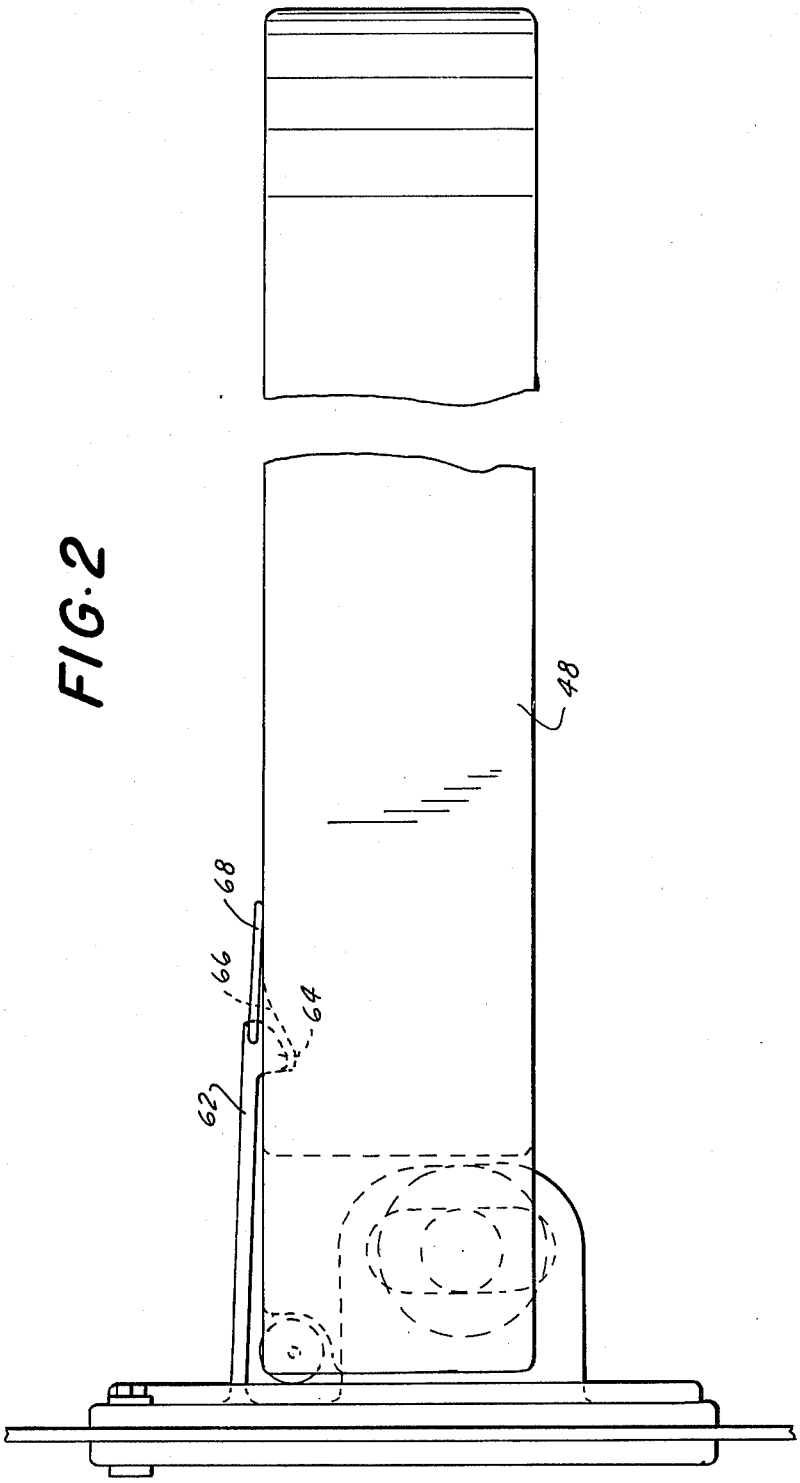
FIG. 2 is an end elevation view thereof.

The belt portion of the boom of the present invention can be quite similar in general structure to the belt in U.S. Pat. No. 3,922,860, discussed above, and accordingly the details of the general flexible belt structure will not be reviewed in detail herein. Naturally other alternative well known belt structures in common use can also be employed.

Accordingly, attention is directed to the float attachment assembly 20 of the invention which as shown in the drawings is mounted to a flexible belt 22 which forms a vertical barrier as part of a floatable containment boom for oil or other similar pollutants. The float assemblies or attachments 20 are arranged in pairs on opposite sides of boom 22 and are spaced along the length of the boom sections at predetermined intervals similar to the arrangement in U.S. Pat. No. 3,922,860.

The improved structure resides in float attachment 20 which includes a flat plate-like support 24 with a relatively flat inner surface 26 for mounting to the flat adjacent surface of the belt 22.

The opposite side of flat support 24 includes a laterally extending hub 28 which has a longitudinal passageway 30 therethrough. The somewhat cylindrically shaped hub 28 has a small interrupted portion remote from plate 24. The hub 28 can be formed as an integral part of plate 24 or mounted thereto in conventional fashion. The outer configuration of hub 28 which contains passageway 30 has the shape of two opposing frustoconical portions 32 and 34 with their narrower diameter ends interconnecting. The configuration of the inner surface forming passageway 30 conforms to the outer surface of portions 32 and 34 so that passageway 30 has a narrow diameter center portion 36 and tapers outward to wider diameter open end 38 and opposing wider diameter open end 40.

Figure 4:
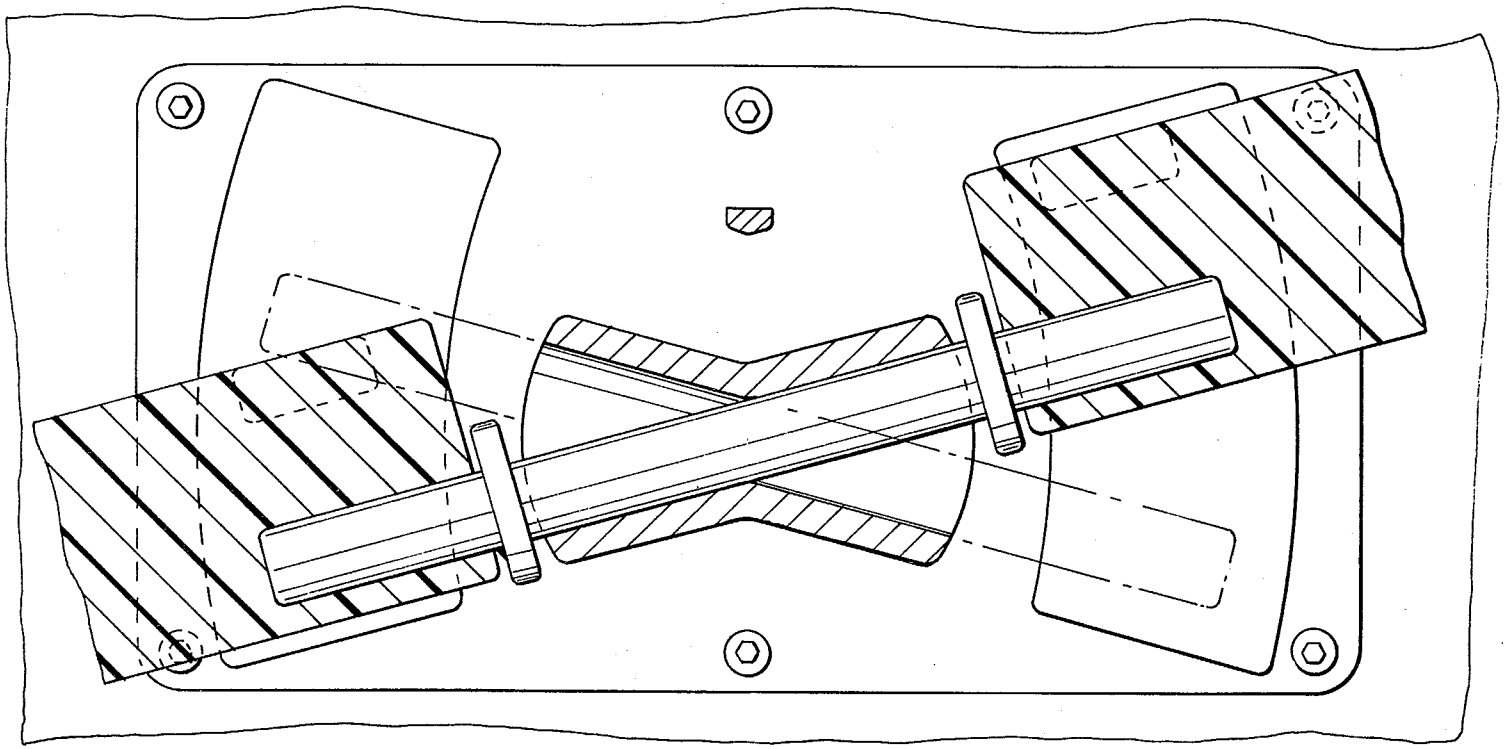
FIG. 4 is a sectional view thereof similar to that of FIG. 3 and showing the float in tilted position in one direction and tilted in the opposite direction in phantom.

Mounted in passageway 30 is a cylindrical axle 42 extending substantially parallel to the axial length of plate 24 and accordingly belt 22 when the assembly 20 is mounted thereto. Axle 42 is longer than hub 28 so that it has one end portion 44 extending through opening 40 and a second opposite end 46 extending from opening 38 of the hub. The outer diameter of axle 42 is substantially uniform and is slightly smaller than the smallest inner diameter portion 36 at the center of hub 28. Thus, axle 42 is free to rotate within hub 28 and is also free to tilt either clockwise or counter clockwise, as shown in FIG. 4, to the degree determined by the widest diameter of passageway 30. It is been found effective to taper the passageway at a 15 degree angle so that a 15 degree tilt is provided either clockwise or counter clockwise for axle 42.

Mounted on axle 42 is a float member 48 having an enlarged somewhat flat configuration with appropriate arcuate and beveled surfaces to facilitate ease of floatation and towing of the float member 48 when it is in an operable position as a support for the boom and particularly belt 22. The inner edge 50 of float 48 which is adjacent to the support plate 24 for mounting thereto has a central rectangularly shaped recess 52 for receipt of the hub 28 and the central portion of axle 42 therein. End 44 of axle 42 extends into a receiving recess 54 of float 48 open to recess 52. Similarly, end portion 46 of the axle extends into a receiving recess 56 on the opposing side of central recess 52. To prevent axle 42 from extending too far in either direction into recesses 54 and 56, a pair of axle lock/bearing rings are seated in appropriate receiving grooves in the portions of axle 42 between the recesses 54 and 56 and the passageway 30 in hub 28. Thus ring 58 is mounted on one side of hub 28 and ring 60 is mounted on the axle on the other side of hub 28. These axle locking rings 58 and 60 maintain the axle in relative fixed position in an axial direction with respect to the float 48 and the hub 28. In this manner, float 48 is mounted to hub 28 and accordingly to the remainder of the supporting structure plate 24. The float 48 is permitted whatever freedom of movement is achieved through its rotation about axle 42 and whatever freedom of tilt is provided as axle 42 tilts within passageway 30.

As can be seen from the drawings, float 48 is free to rotate downward into close adjacent relationship to the adjacent outer exposed surface of plate 24 for facilitating folding and storage of a boom on which the float assembly 20 is mounted. The float is also free to rotate upward until it comes into contact with a lock arm 62 formed integrally with plate 24 and extending laterally outward therefrom to form a cantilever member. Naturally the arm 62 can be mounted in a conventional fashion to plate 24 instead of being cast or otherwise integrally formed therewith. The lock arm terminates in a downwardly extending latch tongue 64 and the arm 62 is cast at a predetermined downward angle, for example 5 degrees to facilitate the provision of a spring tension to hold the float in the horizontal or fully laterally extending position. The tongue 64 is positioned to extend into a latch well 66 in the upper surface of the float 48 and engage with the surfaces forming the well 66 so as to hold the float in the lateral operable floating position. Latch arm 62 has sufficient resilience and shiftability to permit it to be shifted out of latch well 66 which will release float 48 to permit it to fall by gravity and rotate downward into engagement with or close to the adjacent surface of flat plate 24. To assist in shifting of latch arm 62 out of latch well 66, a lift ring 68 is provided and is mounted through an appropriate aperture in the end of the latch arm 62. Shifting of the float 48 upward will automatically displace tongue 64 and cause frictional interengagement between the tongue 64 and the surfaces forming latch well 66 thus automatically holding the float 48 in the lateral and operable floating position. Grasping of ring 68 and displacing of tongue 64 from latch well 66 permits the float to rotate and fall into the storage position for collapsing of the boom.

To accommodate for the frictional bearing surface between the float 48 and the plate 24 as it is tilted due to angular shifting of axle 42 in passageway 30 and also as the float 48 is rotated downward and upward between the vertical downward position and the horizontal lateral position, a pair of spaced rollers 70 and 72 are provided. Roller 70 is located in a small recess 74 on one side of larger recess 52 and similarly roller 72 is located in a smaller recess 76 on the other side of larger recess 52. These recesses are located in the inner edge 50 of float 48. The rollers are free to rotate as they are mounted on pins which form axes of rotation. Thus, roller 70 is mounted on pins 78 which has its ends captured in opposing smaller recesses 80 and 82 formed in the side walls of recess 74. Similarly, roller 72 is mounted on pin 84 which has its ends mounted in smaller recesses 86 and 88 in the side walls of recess 76. Rollers 70 and 72 extend slightly outward from inner edge 50 so as to form the bearing surfaces for the inner edge. To accommodate the bearing surface formed by roller 70 a bearing surface projection 90 extends inward from plate 24 in alignment with roller 70 and a similar bearing surface projection 92 extends inward from plate 24 in alignment for engagement with rollers 72. Thus the engaging surfaces between the support 24 and the movable float are controlled to provide maximum wear and reduced friction. It is been found effective to form the rollers 70 and 72 of a nylon material or similar substitute therefor.

Support plate 24 can be mounted to belt 22 in any of a number of well known ways to rigidly mount the plate in position. However, one way which has been found to be preferred is to form a cooperating relationship between plate 24 on one side of belt 22 and a plate 94 on the other side of belt 22 which forms part of a separate float attachment assembly used to balance the float arrangement and maintain the belt in a vertical position. To accomplish this result, plate 94 is provided with threaded holes and also with threaded cast-in nipples 96 added to the hole to receive a plurality of bolts 98 extending in alignment therewith through appropriate apertures in plate 24 and belt 22. Thus, the opposing plate and accordingly the opposing assemblies 20 are mounted by one set of bolt arrangement to the belt 24 at a predetermined location. The number of bolts is a matter of choice however, in the depicted embodiment, six bolts are utilized.

Float 48 is formed of a conventional material such as a well known plastic closed/cell foam. The support plate 24, hub 28 and latch arm 62 can be formed of a single cast material of appropriate metal or plastic.

The hinged action of the float 48 facilitates compact storage when the float is released for the downward shifting into close adjacent relationship to the surface of plate 24. Latch arm 62 locks the float in the horizontal laterally extending or 90 degree position with respect to the barrier or belt 22 for towing and floatation of the boom. The locking action is achieved by the natural resilience of the latch arm material as well as the angular casting attitude to provide the downward tension. As stated above, a 5 degree cast in a downward direction has proved to be sufficient to provide the necessary spring tension to hold the float in position. The casting angle is a matter of choice as can be readily envisioned.

While the float is in the operable substantially horizontally position, it has freedom to tilt even while prevented from rotation since axle 42 is tiltable within passageway 30 in hub 28. The amount of tilt is determined by the angular orientation of the axle which once again is a matter of choice. It has been found that a tilt of about 15 degrees from the horizontal causes the float to operate effectively. However, more or less angle is acceptable as well. The angle of tilt is achieved both clockwise and counter clockwise while the float 48 is confined at the 90 degree or horizontal position with respect to the belt 22 and thus substantially parallel to the water line.

The spaced twin rollers, the number of rollers is a matter of choice, 70 and 72 eliminate the wearing action of sliding friction where the inner and top edges of floats 48 would rotate to 15 degrees or any other chosen angle against the float support plate 24. The float bearing surfaces 90 and 92 accommodate the force of the rollers and act with the rollers to eliminate unwanted friction of the float against the float support.

The two axle-lock/bearing rings 58 and 60 on the axle between the float and the hub ends within recess 52 lock float 48 in position and provide bearing surfaces between float 48 and the open ends of the hub 28 and also keep the axle 42 from sliding in either direction into the opposing recesses 54 and 56 in float 48.

Assembly 20 eliminates any possible pollution leak through the structure since there are no axle holes from one side of the belt 22 to the other.

The bolts 98 extend through plate 24 and screw into lock nut threaded holes in plate 94 on the other side of belt 22. This eliminates the need of additional nuts and lock washers to mount assemblies 20 in position. It also permits easier cleaning by the presence of a smoother surface and the lack of a hole. Sufficient depth of materials for the thread is obtained by the cast-in raised nipples or projections 96 on the opposing side of plate 94. Thus each pair of assemblies 20 at a location along belt 22 operate in cooperation to facilitate the mounting of both assemblies and thereafter maintain the boom in the desired vertical position and also facilitate folding for storage of the boom when the floats are released for shifting to their lower position.

In operation, the boom formed by assemblies 20 mounted on belt 22 and interconnected sections thereof is stored in a suitable storage container in folded condition. This can be located at dock side with respect to harbor use for the boom or in any other portable or otherwise fixed storage compartment for portable harbor use or deep sea use. In use, as the boom is unfolded the floats are rotated upward to the horizontal position until latch arm 62 snaps into latch well 64 in tight frictional engagement with tongue 64 engaging with the adjacent surfaces of the well 66. The floats extending laterally in this manner operate in maintaining the buoyancy and desired floating orientation of the boom as it is towed to the desired location, arranged in a desired configuration and thereafter fixed in position.

Figure 3:
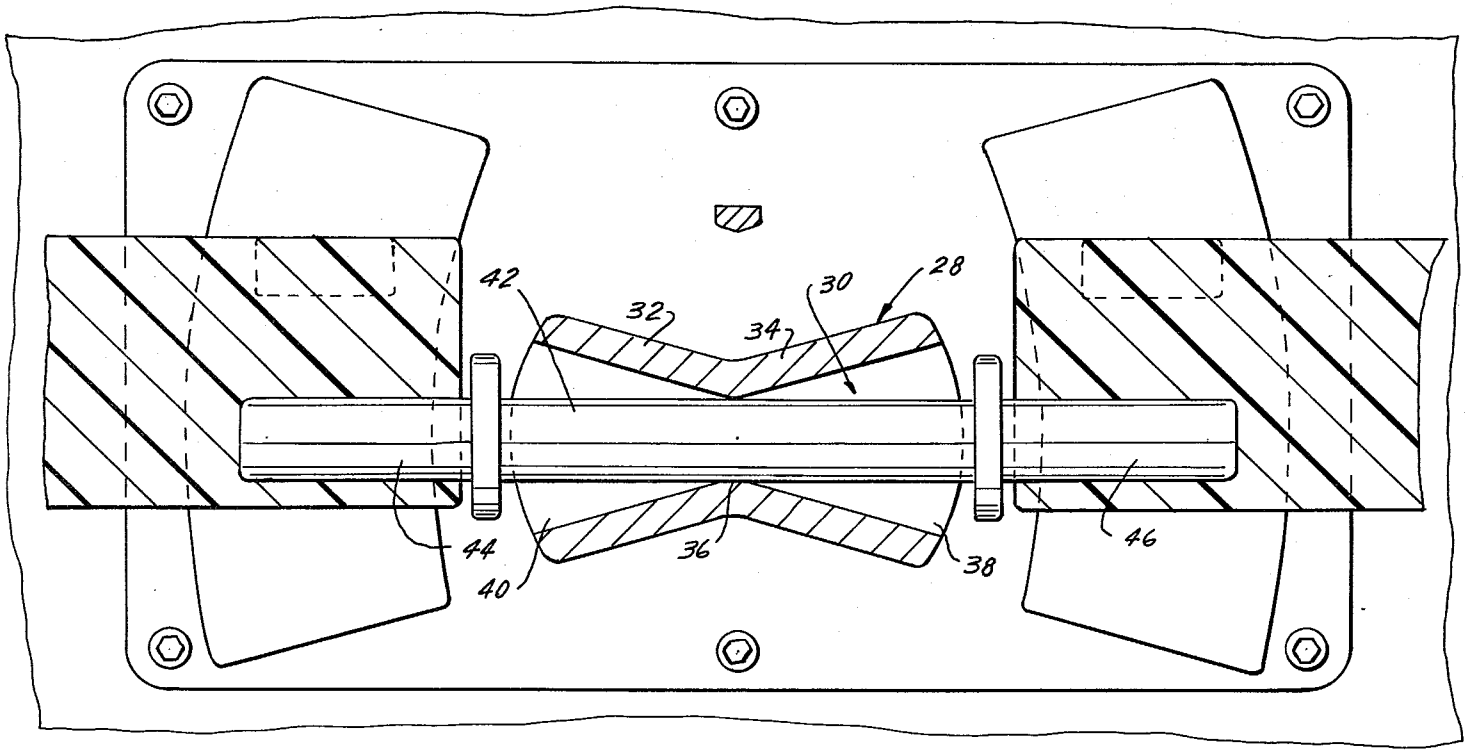
FIG. 3 is a sectional view thereof taken along the plane of line 3—3 of FIG. 1.

To facilitate the towing of the boom, floats 48 are permitted to tilt clockwise and counter clockwise as desired and thus have a limited freedom of movement as axle 42 tilts within passageway 30. This tilting action is also present after the boom has been finally fixed in position thus facilitating the maintenance of the boom in a vertical and the most effective operative position in containing pollutants and particularly when subjected to a wave action on the surface of the water. As stated above, the rollers and appropriate bearing surfaces on the support structure facilitate reduction in friction and wear as this tilting action occurs and as the float is rotated between the storage position and the operable horizontal position. FIG. 4 shows the float tilted in one direction and in phantom shows the manner in which the float can tilt in an opposing direction, that is counter clockwise versus clockwise. FIG. 3 shows the axle and accordingly the float in the non tilted horizontal position.

After use, the boom is towed through the water to the storage location with the tilting action of the floats also acting in facilitating this return to storage procedure. At the storage location, the latch arm can be released by grasping ring 68 and removing the latch arm with sufficient force from frictional engagement with the float. The float will then rotate under the force of gravity and any other suitable manual force found to be necessary about axle 42 into the downward substantially vertical position into adjacent position with respect to plate 24. The boom can then be folded in appropriate folds and stored for later use. No detachment of floats is required.

The axle lock bearings 58 and 60 can be formed of a conventional material such as nylon and can be mounted and removed in any conventional well known manner to permit disassembly and assembly of the axle and accordingly the float with respect to the supporting structure of the assembly.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A float assembly adapted to be mounted on an elongated collapsible belt to form a floatable boom comprising; a support with attachment means for mounting the float assembly on the belt, a float member hinged to the support to be rotatable about an axis substantially parallel to the longitudinal axis of the belt between a first position adjacent to the belt for storage and a second position laterally extended from the belt for facilitating floatation of the boom, the float member being mounted for and restricted to limited angular displacement with respect to the longitudinal axis of the belt when in the second position and releasable means to retain the float member in the second position during use and releasable to permit the float to fall by gravity and rotate about the axis substantially parallel to the longitudinal axis of the belt into the first position in close adjacent relationship to the belt.

2. The invention in accordance with claim 1 wherein the belt is an elongated flat foldable member and a plurality of float assemblies are attached to the belt at predetermined intervals along its length.

3. The invention in accordance with claim 2 wherein the floats are arranged in pairs with each pair of floats being aligned and extending laterally from opposed sides of the belt to facilitate floatation of the belt in a substantially vertical position.

4. A float assembly adapted to be mounted on an elongated collapsible belt to form a floatable boom comprising; a support with attachment means for mounting the float assembly on the belt, a float member hinged to the support to be rotatable between the first position adjacent to the belt for storage and a second position laterally extended from the belt for facilitating floatation of the boom, the float member being mounted for limited angular displacement with respect to the longitudinal axis of the belt when in the second position, each float member is formed with a support including a substantially flat plate, a hub having a passageway therethrough and extending laterally from the plate, an axle mounted in the passageway of the hub and extending axially from both ends of the hub, the float member being formed with a recess adjacent the inner side thereof to receive the hub therein and openings to receive the ends of the axle extending axially from both ends of the hub to mount the float to the hub and accordingly to the support, the axle permitting rotation of the float with respect to the support between a first position adjacent to the support and accordingly to the belt to which the support is mounted and a second position substantially perpendicular to the support and extending laterally therefrom to act as a floatation member for floatation of the boom.

5. The invention in accordance with claim 4 wherein the passageway through the hub is formed by fustroconical shaped openings extending inwardly from both ends so that they have a wide diameter adjacent the ends of the hub and a narrow diameter at the central portion of the hub, the narrow diameter central portion of passageway of the hub being slightly larger than the outer diameter of the axle and the extremeties of the passageway adjacent the ends of the hub being of substantially larger diameter than the axle thereby permitting the axle to tilt in a limited annular displacement in either a clockwise or counter clockwise direction thereby permitting the float to tilt in the same manner and facilitating the floating action of the float as the boom is being towed or is otherwise floating.

6. The invention in accordance with claim 5 wherein the fustroconical shaped portions of the passageway of the hub extend outwardly at an angle of approximately 15 degrees to provide a 15 degree tilt for the axle with respect to the fixed support.

7. The invention in accordance with claim 4 wherein a first axle lock bearing ring is positioned on the axle between the one end of the hub and the adjacent recess on the float and a second axle lock bearing ring is positioned between the other end of the hub and the adjacent recess in the float to lock the float in place and provide bearings between the float and the hub ends as well as preventing the axle from sliding either way into an axle receiving recess in the float.

8. The invention in accordance with claim 4 wherein the flat plate of the support of the float assembly on one side of the belt contains an arrangement of holes for passage of a bolt therethrough and through aligned holes in the belt and the flat plate of the support of the float assembly on the opposing side of the belt has mating lock nut threaded holes for receipt of the respective bolts pass through the plate on the opposite side of the bolt so as to mount opposing float assembly in alignment on both sides of the belt in a quick and efficient manner with a minimum number of component parts.

9. A float assembly adapted to be mounted on an elongated collapsible belt to form a floatable boom comprising; a support with attachment means for mounting the float assembly on the belt, a float member hinged to the support to be rotatable between a first position adjacent to the belt for storage and a second position laterally extended from the belt for facilitating floatation of the boom, the float member being mounted for limited angular displacement with respect to the longitudinal axis of the belt when in the second position, releasable holding means is provided to retain the float in the second position during use and releasable to permit the float to fall by gravity into the first position in close adjacent relationship to the belt, the holding means includes a latch arm fixed at one end to the support and extending laterally therefrom as a cantilever member and terminating in a latch tongue extending downwardly therefrom, the top of each float member containing a latch well for alignment with the latch tongue and shaped to interengage with the latch tongue when subjected to a predetermined force therebetween, the latch arm being releasable by exerting a sufficient predetermined force to displace the latch tongue from the latch well and thus permit the float to return to the first position.

10. The invention in accordance with claim 9 wherein a gripping ring is formed on the latch arm to facilitate gripping of the latch arm and displacing the latch tongue from the latch well to release the float member.

11. A float assembly adapted to be mounted on an elongated collapsible belt to form a floatable boom comprising; a support with attachment means for mounting the float assembly on the belt, a float member hinged to the support to be rotatable between a first position adjacent to the belt for storage and a second position laterally extended from the belt for facilitating floatation of the boom, the float member being mounted for limited angular displacement with respect to the longitudinal axis of the belt when in the second position, each float member contains a pair of spaced rollers mounted in a recess adjacent its inner edge for engagement with an adjacent support surface thereby alleviating wearing action of sliding friction when the float tilts when in the second position and when the float rotates between the second and first positions.

* * * * *